US005578561A

United States Patent [19]

Sakamoto et al.

[11] Patent Number: 5,578,561

[45] Date of Patent: Nov. 26, 1996

[54] NONIONIC POWDERY DETERGENT COMPOSITION

[75] Inventors: Yuichi Sakamoto; Hiroyuki Kondo; Kiyofumi Kida, all of Wakayama, Japan

[73] Assignee: KAO Corporation, Tokyo, Japan

[21] Appl. No.: 551,368

[22] Filed: Nov. 1, 1995

Related U.S. Application Data

[63] Continuation of Ser. No. 132,276, Oct. 6, 1993, abandoned.

[30] Foreign Application Priority Data

Oct. 12, 1992 [JP] Japan ..... 4-272763
Oct. 12, 1992 [JP] Japan ..... 4-272764

[51] Int. Cl.[6] ..... C11D 3/08; C11D 1/72

[52] U.S. Cl. ..... 510/349; 510/438; 510/507

[58] Field of Search ..... 252/174.13, 174.14, 252/174.21, 174.23, 174.25

[56] References Cited

U.S. PATENT DOCUMENTS 4,248,911 2/1981 Wixon ..... 427/214
4,414,130 11/1983 Cheng ..... 252/140

FOREIGN PATENT DOCUMENTS 0477974 4/1992 European Pat. Off. .
2281979 3/1976 France .
2290396 6/1976 France .

OTHER PUBLICATIONS

Database WPI Abstract, Derwent Publications Ltd., London, GB; AN 77–58310Y & JP–A–52 078 904 (Nissan Chem), 26 Dec. 1975.

Database WPI Abstract, Derwent Publications Ltd., London, GB; AN 93–039439 & JP–A–4 363 400 (Kao Corp.), 16 Dec. 1992.

*Primary Examiner*—Gary Geist
*Assistant Examiner*—Barbara S. Frazier
*Attorney, Agent, or Firm*—Birch, Stewart, Kolasch & Birch, LLP

[57] ABSTRACT

A nonionic powdery detergent composition having high solubility and dispersibility which are not impaired even when used for washing in high-temperature water and an excellent caking resistance even during storage under a highly humid condition, which contains, as a starting detergent material used for absorbing the nonionic surfactant, an amorphous aluminosilicate having a composition represented by the following formula (I):

$$x(M_2O).y(MeO).Al_2O_3.z(SiO_2) \quad (I)$$

wherein M represents an alkali metal atom, Me represents an alkaline earth metal atom, and x, y and z represent the molar numbers of the respective components, with the proviso that they satisfy the following relationship:

$$0.2 \leqq x \leqq 2.0,\ 0 \leqq y \leqq 0.1 \text{ and } 1.5 \leqq z \leqq 6.0,$$

and having an oil-absorbing capacity of at least 100 ml/100 g and a water content of 5 to 20% by weight, and wherein the volume of pores having diameters of smaller than 0.1 μm is at most 20% based on the total pore volume and the volume of pores having diameters of 0.1 to 2.0 μm is at least 50% based on the total pore volume.

10 Claims, No Drawings

NONIONIC POWDERY DETERGENT COMPOSITION

This application is a continuation of application Ser. No. 08/132,276 filed on Oct. 6, 1993, now abandoned.

BACKGROUND OF THE INVENTION

1. Field of the Invention

The present invention relates to a detergent composition. Particularly, the present invention relates to a powdery detergent composition comprising a nonionic surfactant as the main base, having high solubility and dispersibility which are not impaired even when used for washing in high-temperature water, and an excellent caking resistance even during storage under a highly humid condition, and optionally having excellent powder flowability, detergency and freedom from bleeding of the nonionic surfactant, which is liquid at ordinary temperatures, and also from the formation of water-insoluble substance during washing in high-temperature water.

2. Description of the Related Art

Nonionic surfactants are regarded as important detergents, since they have excellent durability in hard water, remarkable detergency and stain-dispersing power and extremely high biodegradability. However, many of the nonionic surfactants usually used for washing are liquid at ordinary temperatures. Therefore, when such a liquid nonionic surfactant is incorporated in a large amount into a powdery detergent composition, it gradually bleeds out to soak into the paper container and the flowability of the powdery detergent composition is seriously impaired; or it causes caking to harden the detergent composition into a mass with the lapse of time, thereby seriously reducing the commercial value thereof.

U.S. Pat. No. 4,136,051 (published on Jan. 23, 1979, Assignee: HENKEL & CIE GMBH) discloses a flowable detergent composition which comprises 30 to 100% by weight of a premix (containing 4% by weight or below of highly dispersible silicic acid, if necessary) prepared by finely distributing a nonionic surfactant over zeolite or a mixture of zeolite with an inorganic peroxide compound capable of forming hydrogen peroxide in water and 0 to 70% by weight of a spray-dried detergent composition. Japanese Patent publication-A No. 89300/1986 (published on May 7, 1986) discloses a granular detergent composition containing a nonionic surfactant as a detergent composition having a high flowability and an excellent caking resistance, which comprises granules prepared by mixing water-insoluble granules with silica powder, spraying a nonionic surfactant over the resultant mixture, adding zeolite powder to the resultant mixture and granulating the resultant mixture, and a granular detergent composition containing an anionic surfactant.

However, these disclosures relate to detergent additives containing nonionic surfactants to be added afterward to a spray-dried detergent containing an anionic surfactant as the main detergent base. In fact, detergents comprising a nonionic surfactant as the main detergent base as those in the present invention have not been fully investigated yet.

Great Britain Patent Publication-A No. 1474856 (published on May 25, 1977) discloses a freely flowable detergent composition which comprises a porous aggregate of a synthetic amorphous silica derivative and a nonionic surfactant.

As will be understood from these disclosures, it is known to use a silicious substance for improving the flowability of a detergent composition containing a nonionic surfactant. However, when a silicious substance is incorporated into a zeolite-containing detergent composition, the solubility of the detergent composition tends to be reduced with the elapse of time during storage under a high-humidity condition. Thus, a further improvement has been demanded.

The present inventors previously found that the above-described problem of the reduction in the solubility with the elapse of time during storage under a high-humid condition could be solved by a nonionic powdery detergent composition comprising a specific silica derivative, a nonionic surfactant and a zeolite [see European Patent Publication-A No. 477974 (published on Apr. 1, 1992)]. The present inventors also found that the above-described defects could be remarkably reduced by combining a nonionic surfactant, a zeolite, an amorphous silicious substance having specific properties and sodium carbonate in a specific proportion [see European Patent Publication-A No. 477974 (published on Apr. 1, 1992)]. However, these detergent compositions necessitated a further improvement, since their solubility and dispersibility tended to be reduced when they were used for washing with water at high temperature in summer or as is usual in the U.S.A. or European countries.

DISCLOSURE OF THE INVENTION

Summary of the Invention

Under these circumstances, the present inventors have made extensive investigations on a detergent composition comprising a nonionic surfactant as the main detergent base particularly to solve the above-described problems. As the result, the present inventors have found that a nonionic powdery detergent composition having remarkably improved caking resistance under high-humid conditions and also remarkably improved solubility and dispersibility in high-temperature water can be obtained by combining a nonionic surfactant with an amorphous aluminosilicate having specific properties and, optionally, an alkaline salt and/or a neutral salt. The present invention has been completed on the basis of this finding.

Further, the present inventors have also found that a nonionic powdery detergent composition having remarkably improved bleeding resistance of the nonionic surfactant, which is liquid at ordinary temperatures, remarkably improved powder flowability and resistance to reduction in solubility with time under hygroscopic conditions, and remarkably improved solubility and dispersibility in high-temperature water can be obtained by using, as the amorphous aluminosilicate, those produced by a specific process. The present invention has been completed also on the basis of this finding.

Thus, the present invention provides the following nonionic powdery detergent compositions (1) to (3):

(1) a nonionic powdery detergent composition comprising 12 to 40% by weight, preferably 12 to 35% by weight, of the following component (a) and 5 to 60% by weight, preferably 5 to 40% by weight;, of the following component (b), the component (a) being absorbed in a powdery or granular starting material(s), including the component (b), of the detergent composition:

(a) a nonionic surfactant having a melting point of 40° C. or below, and (b) an amorphous aluminosilicate having a composition represented by the following formula (I):

$$x(M_2O).y(MeO).Al_2O_3.z(SiO_2) \quad (I)$$

wherein M represents an alkali metal atom, Me represents an alkaline earth metal atom, and x, y and z represent the molar numbers of the respective components, with the proviso that they satisfy the following relationship:

$$0.2 \leqq x \leqq 2.0,\ 0 \leqq y \leqq 0.1 \text{ and } 1.5 \leqq z \leqq 6.0,$$

and having an oil-absorbing capacity of at least 100 ml/100 g and a water content of 5 to 20% by weight, wherein the volume of pores having diameters of smaller than 0.1 μm is at most 20% based on the total pore volume and the volume of pores having diameters of 0.1 to 2.0 μm is at least 50% based on the total pore volume, (2) a nonionic powdery detergent composition comprising 12 to 35% by weight of the following component (a), 5 to 40% by weight of the following component (b) and 5 to 70% by weight of the following component (c), the component (a) being absorbed in a powdery or granular starting material(s), including the component (b), of the detergent composition:

(a) a nonionic surfactant having a melting point of 40° C. or below, (b) an amorphous aluminosilicate having a composition represented by the following formula (I):

$$x(M_2O).y(MeO).Al_2O_3.z(SiO_2) \quad (I)$$

wherein M represents an alkali metal atom, Me represents an alkaline earth metal atom, and x, y and z represent the molar numbers of the respective components, with the proviso that they satisfy the following relationship:

$$0.2 \leqq x \leqq 2.0,\ 0 \leqq y \leqq 0.1 \text{ and } 1.5 \leqq z \leqq 6.0,$$

and having an oil-absorbing capacity of at least 100 ml/100 g and a water content of 5 to 20% by weight, wherein the volume of pores having diameters of smaller than 0.1 μm is at most 20% based on the total pore volume and the volume of pores having diameters of 0.1 to 2.0 μm is at least 50% based on the total pore volume, and (c) an alkaline salt and/or a neutral salt, and (3) a nonionic powdery detergent composition comprising 12 to 35% by weight of the following component (a), 5 to 40% by weight of the following component (b), 5 to 70% by weight of the following component (c) and 10 to 60% by weight of the following component (d), the component (a) being absorbed in a powdery or granular starting material(s), including the component (b), of the detergent composition:

(a) a nonionic surfactant having a melting point of 40° C. or below, (b) an amorphous aluminosilicate having a composition represented by the following formula (I):

$$x(M_2O).y(MeO).Al_2O_3.z(SiO_2) \quad (I)$$

wherein M represents an alkali metal atom, Me represents an alkaline earth metal atom, and x, y and z represent the molar numbers of the respective components, with the proviso that they satisfy the following relationship:

$$0.2 \leqq x \leqq 2.0,\ 0 \leqq y \leqq 0.1 \text{ and } 1.5 \leqq z \leqq 6.0,$$

and having an oil-absorbing capacity of at least 100 ml/100 g and a water content of 5 to 20% by weight, wherein the volume of pores having diameters of smaller than 0.1 μm is at most 20% based on the total pore volume and the volume of pores having diameters of 0.1 to 2.0 μm is at least 50% based en the total pore volume, (c) an alkaline salt and/or a neutral salt, and (d) a crystalline aluminosilicate.

In the above-described nonionic powdery detergent compositions, the nonionic surfactant as component (a) is preferably a polyoxyethylene alkyl ether which has an average carbon atom number of 10 to 20 in its alkyl group and an average molar number of added ethylene oxide of 5 to 15.

In the above-described nonionic powdery detergent composition, the component (b) is preferably those compounds which are produced by reacting an alkali metal aluminate with an alkali metal silicate while maintaining the pH of the reaction system in the range of 8 to 14 by the addition of at least one acidic agent selected from the group consisting of an inorganic acid, an organic acid and an acidic salt.

In the process for preparing the component (b) described above, it is preferred to use, as the starting materials, an alkali metal aluminate having a molar ratio of $M_2O$ (M being an alkali metal atom) to $Al_2O_3$ in the range of 1.0 to 6.0 and an alkali metal silicate having a molar ratio of $SiO_2$ to $M_2O$ in the range of 1.0 to 4.0.

The reaction of the alkali metal aluminate with the alkali metal silicate is preferably conducted in two steps, a reaction step and an aging step, the temperature of the reaction step being 15° to 60° C. and the temperature of the aging step being 15° to 100° C., and/or in a reaction system containing a water-soluble solvent having a solubility parameter of 7.5 to 20 in an amount of 0.5 to 50% by weight.

The reaction of the alkali metal aluminate with the alkali metal silicate is preferably conducted in the presence of a water-soluble solvent having a solubility parameter of 7.5 to 20 in an amount of 0.5 to 50% by weight based on the entire amount of the reaction system. The water-soluble solvent is added prior to the reaction of an alkali metal aluminate with an alkali metal silicate to constitute the reaction system or added in the course of the reaction.

Furthermore, in the process for preparing the component (b) described above, it is preferred to add at least one acidic agent selected from the group consisting of an inorganic acid, an organic acid and an acidic salt to the slurry obtained by the reaction of the alkali metal aluminate with the alkali metal silicate to adjust the pH of the slurry within the range of 5 to 13 and at least 1 lower than that of the reaction system of the alkali metal aluminate with the alkali metal silicate during reaction.

Further scope and the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

The nonionic surfactant to be used as component (a) in the present invention is one having a melting point of 40° C. or below and is typically useful as a component of detergent compositions. This component (a) preferably forms a solution or slurry at a temperature of 40° C. or below.

In the present invention, it is desirable to use an ethylene-oxide-adduct-type nonionic surfactant as the main base of the nonionic surfactant (a). Examples of ethylene-oxide-adduct-type nonionic surfactants include polyoxyethylene sorbitan fatty acid esters, polyoxyethylene sorbitol fatty acid esters, polyoxyethylene polyoxypropylene alkyl ethers, polyoxyethylene castor oils, polyoxyethylene hardened castor oils and polyoxyethylene alkylamines.

Among the above-described ethylene-oxide-adduct-type nonionic surfactants, a polyoxyethylene alkyl ether obtained by adding preferably 5 to 15 mol, more preferably 6 to 12 mol, and most preferably 6 to 10 mol, on the average, of ethylene oxide to a linear or branched, primary or secondary alcohol having, on the average, preferably 10 to 20 carbon atoms, more preferably 12 to 18 carbon atoms in its alkyl group.

In the present invention, a nonionic surfactant other than the ethylene-oxide-adduct-type nonionic surfactant may be used in combination with the ethylene-oxide-adduct-type nonionic surfactant. Examples of nonionic surfactants other than the ethylene-oxide-adduct-type nonionic surfactant include polyethylene glycol fatty acid esters, glycerol fatty acid esters, higher fatty acid alkanolamides, alkyl glucosides and alkylamine oxides.

In the present invention, the amount of the ethylene-oxide-adduct-type nonionic surfactant is preferably at least 60% by weight in the nonionic surfactants (a). Particularly when at least 60% by weight in the nonionic surfactants (a) of an ethylene-oxide-adduct-type nonionic surfactant is used, a detergent composition having excellent detergency, foaming and foam breakage is obtained. The water content of the nonionic surfactant (a) should be low because water causes the production of water-insoluble substance or matter.

The component (a) is incorporated in an amount of 12 to 40% by weight, preferably 12 to 35% by weight and more preferably 15 to 30% by weight in the composition of the present invention. When the amount of component (a) is below 12% by weight, no sufficient detergency can be obtained and the stain-removing effect is insufficient. On the contrary, when the amount of component (a) exceeds 40% by weight, the nonionic surfactant bleeds out to cause caking and the reduction of the solubility of the detergent composition during the storage of the detergent composition.

The amorphous aluminosilicate as component (b) of the present invention has a composition represented by the following formula (I):

$$x(M_2O).y(MeO).Al_2O_3.z(SiO_2) \quad (I)$$

wherein M represents an alkali metal atom, Me represents an alkaline earth metal atom, and x, y and z represent the molar numbers of the respective components, with the proviso that they satisfy the following relationship:

$$0.2 \leqq x \leqq 2.0,\ 0 \leqq y \leqq 0.1 \text{ and } 1.5 \leqq z \leqq 6.0,$$

$$\text{preferably } 0.7 \leqq x \leqq 1.7,\ 0 \leqq y \leqq 0.1 \text{ and } 1.8 \leqq z \leqq 4.5,$$

and has an oil-absorbing capacity of at least 100 ml/100 g, preferably at least 150 ml/100 g, and a water content of 5 to 20% by weight, preferably 7 to 15% by weight, wherein the volume of pores having diameters of smaller than 0.1 μm is at most 20%, preferably at most 15%, based on the total pore volume, and the volume of pores having diameters of 0.1 to 2.0 μm is at least 50%, preferably at least 60%, based on the total pore volume.

In the present invention, the oil-absorbing capacity is determined according to JIS K 6220 and the pore diameter distribution is determined with a porometer "Pore Sizer 9320" mfd. by Shimadzu Corporation.

The water content is usually determined based on a difference in weight before and after drying at 800° C. However, since silanol groups and the like of the amorphous aluminosilicate are dehydrated by the reaction when the drying is conducted at 800° C., the water content determined by this method is higher than the actual water content of the amorphous aluminosilicate. Therefore, in order to accurately determine the water content, a method which will be described below is employed in the present invention.

An accurately weighed aluminosilicate sample is dispersed in a given amount of heavy water ($D_2O$), DHO thus formed according to the following formula is determined by $^1$H-NMR spectrometry, and the water content of the aluminosilicate sample is calculated by reading the ratio of the integrated strength of DHO peaks (from which the DHO content of commercial heavy water has been deducted) to the integrated strength of the peak of an internal standard substance previously added:

$$H_2O + D_2O \rightarrow 2DHO$$

In the present invention, the drying conditions (temperature and time) are controlled in order to adjust the water content of the amorphous aluminosilicate to be used to the preferred value.

The component (b) is incorporated in an amount of 5 to 60% by weight, desirably 5 to 40% by weight, more desirably 10 to 40% by weight, particularly desirably 10 to 30% by weight and most desirably 10 to 20% by weight in the composition of the present invention. When the amount of component (b) is below 5% by weight, no sufficient absorption of the nonionic surfactant is possible and the caking resistance, solubility and dispersibility of the detergent composition are deteriorated by the bleeding out of the nonionic surfactant. On the contrary, when the amount of component (b) exceeds 60% by weight, the excellent rinsing effect of the detergent composition is impaired to leave the detergent composition in the clothes or the like, since the component (b) is insoluble in water.

The amorphous aluminosilicate (b) of the present invention is preferably produced by reacting an alkali metal aluminate with an alkali metal silicate while maintaining the pH of the reaction system in the range of 8 to 14 by the addition of at least one acidic agent selected from the group consisting of an inorganic acid, an organic acid and an acidic salt. Since the particles of a water-insoluble substance, i.e., amorphous aluminosilicate thus produced do not aggregate each other and, therefore, the particle size of the amorphous aluminosilicate does not become large during storage of the detergent composition for long periods of time, the solubility and dispersibility of the detergent composition, particularly the amorphous aluminosilicate, in water does not lower.

In the production of the amorphous aluminosilicate (b) described above, it is desirable to use, as the starting materials, an alkali metal aluminate having a molar ratio of $M_2O$ (M being an alkali metal atom) to $Al_2O_3$ in the range of 1.0 to 6.0 and an alkali metal silicate having a molar ratio of $SiO_2$ to $M_2O$ in the range of 1.0 to 4.0. The alkali metal aluminate is preferably used in the form of an aqueous solution thereof.

As for the inorganic acid, organic acid and acidic salt to be used as the acidic agent in the production of the amorphous aluminosilicate (b) described above, examples of the inorganic acid include sulfuric acid, hydrochloric acid, nitric acid, carbonic acid, phosphoric acid, etc.; examples of the organic acid include Formic acid, acetic acid, burytic acid, caproic acid, acrylic acid, oxalic acid, succinic acid, adipic acid, benzoic acid, citric acid, etc.; and examples of the acidic salt include incompletely neutralized salts of the above-described inorganic and organic acids such as an incompletely neutralized sodium phosphate, an incompletely neutralized sodium citrate and an incompletely neutralized sodium succinate. The acidic agents are not limited to those listed above, and they may be used either singly or in the form of a mixture of two or more acidic agents.

Acids capable of forming neutralized salts which pose no problem after incorporation into the detergent composition, such as sulfuric acid, carbonic acid, phosphoric acid and citric acid, are particularly desirable as the acidic agent. When carbonic acid is to be used as the acidic agent, the purpose can be attained also by blowing gaseous carbon dioxide into the reaction system.

In the production of the amorphous aluminosilicate (b) described above, the pH of the reaction system during the reaction of the alkali metal aluminate with the alkali metal silicate ranges from 8 to 14, desirably from 9.5 to 13.5.

When the nonionic surfactant is absorbed or occluded in the amorphous aluminosilicate produced as described above and the resultant product is incorporated into the detergent composition, the solubility and dispersibility of the detergent composition in high-temperature water are remarkably improved and the excellent Solubility and dispersibility can be observed even after the storage of the detergent composition for a long period of time.

The reaction temperature of the alkali metal aluminate with the alkali metal silicate, that is, the temperature of the reaction step, is desirably 15° to 60° C., particularly desirably 30° to 50° C. The reaction time of the reaction step is desirably 3 to 120 min. After the completion of the reaction step, an aging step is desirably conducted at 15° to 100° C. for at least 1 min, preferably at least 30 min. The aging step comprises maintaining the temperature of the system constant after the reaction step. The reaction mixture of the reaction step comprises an oxide of an inorganic compound, i.e., aluminosilicate, a hydrate of the aluminosilicate and a hydroxide of the aluminosilicate. When the reaction mixture has been left to stand at a constant temperature, the hydrate of the aluminosilicate and the hydroxide of the aluminosilicate in the reaction mixture turn into aluminosilicate. This step is the aging step.

The production process of the amorphous aluminosilicate (b) described above further comprises the step of adding at least one acidic agent selected from the group consisting of an inorganic acid, an organic acid and an acidic salt to the slurry obtained by reacting an alkali metal aluminate with an alkali metal silicate to adjust the pH of the slurry within the range of 5 to 13 and at least 1 lower than that of the reaction system of the alkali metal aluminate and the alkali metal silicate during reaction, preferably. This step is generally conducted after the aging step. The acidic agents usable herein may be the same as those used in the reaction step. Examples of the inorganic acid include sulfuric acid, hydrochloric acid, nitric acid, carbonic acid, phosphoric acid, etc.; examples of the organic acid include formic acid, acetic acid, burytic acid, caproic acid, acrylic acid, oxalic acid, succinic acid, adipic acid, benzoic acid, citric acid, etc.; and examples of the acidic salt include incompletely neutralized salts of the above-described inorganic and organic acids such as an incompletely neutralized sodium phosphate, an incompletely neutralized sodium citrate and an incompletely neutralized sodium succinate. The acidic agents are not limited to those listed above, and they may be used either singly or in the form of a mixture of two or more acidic agents.

Acids capable of forming neutralized salts which pose no problem after incorporation into the detergent composition, such as sulfuric acid, carbonic acid, phosphoric acid and citric acid, are particularly desirable as the acidic agent. When carbonic acid is to be used as the acidic agent, the purpose can be attained also by blowing gaseous carbon dioxide into the reaction system.

The amorphous aluminosilicate thus obtained has a further improved solubility in high-temperature water and a high oil-absorbing capacity.

It is still preferred in the production of the amorphous aluminosilicate described above to be present 0.5 to 50% by weight, of the entire amount of the reaction system, of a water-soluble solvent having a solubility parameter [refer to C. M. Hansen, J. Paint Tech., 39, 104 (1967); hereinafter referred to as "SP value"] of 7.5 to 20 in the reaction system. The amorphous aluminosilicate thus obtained has a higher oil-absorbing capacity. The solvent may be added to the solutions of the starting materials prior to the reaction or to the reaction mixture in the course of the reaction. The solvents are preferably methanol, ethanol, isopropanol, acetone, ethyl acetate, ethylene glycol, etc.

Among the amorphous aluminosilicates produced by the above-described production conditions, those represented by the following formula (II):

$$x'(M_2O).y'(MeO).Al_2O_3.z'(SiO_2) \quad \text{(II)}$$

wherein M represents an alkali metal atom, Me represents an alkaline earth metal atom, and x', y' and z' represent the molar numbers of the respective components, with the proviso that they satisfy the following relationship:

$$0.5 \leqq x' \leqq 1.7,\ 0 \leqq y' \leqq 0.1 \text{ and } 1.8 \leqq z' \leqq 4.5,$$

have a calcium ion exchange capacity of at least 120 $CaCO_3$ mg/g and, therefore, are excellent also as builders.

The calcium ion exchange capacity is determined as follows: About 0.1 g of an amorphous aluminosilicate sample is accurately weighed and is added into 100 ml of an aqueous calcium chloride solution containing 500 ppm of calcium chloride, with the proviso that the calcium carbonate content in the solution is substituted for the calcium chloride content in the solution. The resultant mixture is stirred at 25° C. for 15 min and then filtered through a Toyo Filter Paper No. 5C under suction. The calcium ion concentration in the filtrate is determined with EDTA to calculate the calcium ion exchange capacity.

The amorphous aluminosilicate used as component (b) in the present invention has an oil-absorbing capacity of at least 100 m/100 g and preferably at least 150 ml/100 g. When the oil-absorbing capacity of the amorphous aluminosilicate is less than 100 ml/100 g, the nonionic surfactant cannot be sufficiently absorbed or occluded in the amorphous aluminosilicate and, therefore, bleeds out to cause caking of the detergent composition and a reduction in the solubility of the detergent composition.

It is desirable to incorporate an alkaline and/or neutral salt as component (c), in addition to the above-described components (a) and (b), in the powdery detergent composition of the present invention. The alkaline and/or neutral salts are either an inorganic salt or an organic salt which gives an aqueous solution thereof having a pH of 7 or above.

Examples of the inorganic salt include sulfates, carbonates, hydrogencarbonates, sesquicarbonates, silicates, layer-silicates, borates, tetraborates, phosphates, polyphosphates, tripolyphosphates and pyrophosphates of alkali metals. Examples of the organic salt include phosphocarboxylates, such as a 2-phosphonobutane-1,2-dicarboxylate, of alkali metals; alkali metal salts of amino acids, such as an aspartate and an glutamate; aminopolyacetates, such as an aminotri-(methylenesulfonate), a 1-hydroxyethylidene-1,1-disulfonate, an ethylenediaminetetra(methylenephosphonate), a diethylenetriaminepenta(methylenesulfonate), a nitrilotriacetate and an ethylenediaminetetraacetate, of alkali metals; a citrate of an alkali metal; a polyacrylate of an alkali metal; a polyaconitate of an alkali metal; a diglycolate of an alkali metal; a hydroxycarboxylate of an alkali metal; salts of polyacetal carboxylic acid polymers described in Japanese Patent Publication-A No. 52196/1979, specially a polymer represented by the formula:

$$-(\underset{\underset{\text{COOM}}{|}}{\text{CH}}-\text{O})_m-$$

[wherein M represents an alkali metal atom, a quaternary ammoniun or an alkanol amine, and m (average degree of polymerization) is 10 to 200]; a p-toluenesulfonate of an alkali metal; and a sulfosuccinate of an alkali metal.

When the powdery detergent composition of the present invention contains such an alkaline and/or neutral salt (c), the solubility and dispersibility of the powdery detergent composition in high-temperature water can be improved. That is, the solubility and dispersibility of the detergent granules comprising the nonionic surfactant (a), the amorphous aluminosilicate (b) and the alkaline and/or neutral salt (c) in high-temperature water is excellent. These salts act also as builders. The alkaline and/or neutral salt is preferably selected from those listed above. It is incorporated in an amount of 5 to 70% by weight, preferably 10 to 70% by weight and more preferably 10 to 50% by weight in the composition of the present invention. When the amount of the alkaline and/or neutral salt is below 5% by weight, the above-described effect can not be obtained and, on the contrary, when the amount of the alkaline and/or neutral salt exceeds 70% by weight, the amount of the other components is limited, thereby reducing the detergency of the detergent composition.

The composition of the present invention may contain a crystalline aluminosilicate as component (d), in addition to the above-described components (a), (b) and (c), in order to further improve the dispersibility of the detergent granules comprising the nonionic surfactant, the amorphous aluminosilicate and the crystalline aluminosilicate and the caking resistance of the detergent composition. The crystalline aluminosilicate (zeolite) is preferably a synthetic zeolite represented by type-A or type-X zeolite of the following formula (1) and having an average primary particle diameter of 0.1 to 20 μm, preferably 1 to 10 μm:

$$u(M_2O).Al_2O_3.v(SiO_2).w(H_2O) \quad (1)$$

wherein M represents an alkali metal atom, and u, v and w represent the molar numbers of the respective components, which are usually as follows:

$$0.7 \leqq u \leqq 1.5,\ 0.8 \leqq v \leqq 6$$

and w is any positive number.

Among them, those represented by the following formula (2) are particularly preferably used:

$$Na_2O.Al_2O_3.n(SiO_2).m(H_2O) \quad (2)$$

wherein n represents a number of 1.8 to 3.0 and m represents a number of 1 to 6.

Such a zeolite is incorporated, in the form of a powder or aggregated dry zeolite particles obtained by drying zeolite slurry, in the detergent composition. The crystalline aluminosilicate can be incorporated in the composition of the present invention in an amount of 10 to 60% by weight, preferably 20 to 50% by weight and more preferably 30 to 50% by weight.

When an ordinary amorphous aluminosilicate or an amorphous aluminosilicate prepared by a conventional process was used for the production of the nonionic powdery detergent composition or, more specifically, when the nonionic surfactant was absorbed in an ordinary amorphous aluminosilicate and the resultant substance was used for the production of the nonionic powdery detergent composition, the solubility and dispersibility of the obtained detergent composition in high-temperature water of 30° C. or above were seriously deteriorated during storage at high temperature. This phenomenon occurred supposedly for the following reasons: When the nonionic surfactant is absorbed in an amorphous aluminosilicate having a small pore diameter and the resultant substance is dissolved in high-temperature water of 30° C. or above, the nonionic surfactant is difficultly dissolved out from the pores. Further, when the water content of the amorphous aluminosilicate is high, the nonionic surfactant gels in the pores of said aluminosilicate to aggregate the aluminosilicate particles, thereby reducing the dispersibility and accordingly the solubility of the detergent granules. In addition, it has also been found that when an amorphous aluminosilicate has a very low water content, the hygroscopicity of this aluminosilicate is extremely high and, therefore, a detergent composition containing such an amorphous aluminosilicate cakes under a high-humidity condition.

After extensive investigations on the above-described problems, the inventors have found that these problems are solved when the detergent composition is produced by using the specific amorphous aluminosilicate described above as component (b) for absorbing the nonionic surfactant (a) and preferably further incorporating the alkaline and/or neutral salt as component (c). Further, when the crystalline aluminosilicate as component (d) is also incorporated in the detergent composition, the caking resistance of the composition can be further improved.

In the present invention, the nonionic surfactant (a) is absorbed in the amorphous aluminosilicate (b) and, if necessary, other starting material(s) which is generally used for producing a granular detergent composition. Examples of the other starting material(s) include a synthetic zeolite, i.e., component (d).

The powdery detergent composition of the present invention may contain, if necessary, typical auxiliary additives, in addition to the above-described components, such as an antiredeposition agent, e.g. polyvinyl alcohol, polyvinylpyrrolidone and carboxymethylcellulose; an enzyme, e.g. protease, lipase, cellulase and amylase; a caking resistant, e.g. talc and calcium; an antioxidant, e.g. tert-butylhydroxytoluene and distyrenated cresol; a fluorescent dye; a bluing agent; and a fragrance. These additives are not particularly limited and they are usable depending on the purpose. In addition, a small amount of a cationic surfactant or the like may be added when a detergent composition also having a softening effect is intended; a small amount of a bleaching agent such as sodium percarbonate, sodium perborate monohydrate and sodium perborate tetrahydrate may be added when a detergent composition also having a bleaching effect is intended; and a small amount of an anonic surfactant or the like may be added when the detergency for removing muds is to be enhanced.

Although the process for producing the powdery detergent composition of the present invention is not particularly limited, it can be easily produced by slowly adding or spraying the liquid nonionic surfactant (a) to or over the amorphous aluminosilicate (b) and, if necessary, the alkaline and/or neutral salt (c) and the crystalline aluminosilicate (d) under stirring to obtain a homogeneous mixture, then adding minor components such as a fragrance and an enzyme, and even a bleaching agent when the bleaching detergent composition is intended, to the homogeneous mixture and mixing the resultant mixture.

EXAMPLES

The present invention will now be described in more detail with reference to the following Examples which should not be considered to limit the scope of the present invention.

Examples of the synthesis of the amorphous aluminosilicates to be used as component (b) of the present invention will also be given below.

SYNTHESIS EXAMPLE A-1

1010 g of an aqueous sodium aluminate solution (1.55% by weight of $Na_2O$ and 2.30% by weight of $Al_2O_3$, the molar $Na_2O/Al_2O_3$ ratio being 1.11) was heated to 40° C., and 700 g of an aqueous sodium silicate solution (2.75% by weight of $Na_2O$ and 7.88% by weight of $SiO_2$, the molar $SiO_2/Na_2O$ ratio being 2.96) and 1.2 g of calcium chloride dihydrate were added thereto under stirring at 1500 rpm for a period of 20 min to effect a reaction. After the completion of the addition, the reaction mixture was heated to 60° C. and maintained at that temperature for 15 min, and then a solid product was separated by filtration and washed. The wet cake thus obtained was dried at 105° C. under 300 Tort for 10 hr and then pulverized to obtain fine aluminosilicate powder which was amorphous according to X-ray crystallography.

According to atomic absorption spectrometry and plasma atomic emission spectrometry, the resultant amorphous aluminosilicate comprised 21.1% by weight of $Al_2O_3$, 57.2% by weight of $SiO_2$, 20.84 by weight of $Na_2O$ and 0.9% by weight of CaO (1.65 $Na_2O$.0.08 $CaO.Al_2O_3$. 4.75 $SiO_2$). The product had an oil-absorbing capacity of 210 ml/100 g, a relative amount of the pores having a diameter of smaller than 0.1 μm of 12.3% by volume, a relative amount of the pores having a diameter in the range of 0.1 to 2.0 μm of 72.1% by volume, and a water content of 11% by weight.

SYNTHESIS EXAMPLES A-2

100 g of an aqueous No. 3 water glass solution (prepared by adding 200 parts by weight of deionized water to 100 parts by weight of No. 3 water glass having a $SiO_2$ content of 29% by weight available on the market) was added dropwise into 800 g of an aqueous sodium aluminate solution (prepared by adding 2000 parts by weight of deionized water to 100 parts by weight of sodium aluminate having a weight ratio of $Na_2O$ to $Al_2O_3$ of 20.3:28.2) having a $Na_2O$ content of 1.99% by weight and a $Al_2O_3$ content of 2.77% by weight at 40° C. for a period of 20 min to effect a reaction. After the completion of the dropwise addition, heat treatment was conducted at 60° C. for 20 min, and then a solid product was separated by filtration and washed. The wet cake thus obtained was dried at 120° C. for 12 hr and then finely pulverized on a crusher to obtain amorphous aluminosilicate powder.

According to atomic absorption spectrometry and plasma atomic emission spectrometry, the resultant amorphous aluminosilicate comprised 27.2% by weight of $Al_2O_3$, 51.2% by weight of $SiO_2$ and 21.6% by weight of $Na_2O$ (1.31 $Na_2O.Al_2O_3$.3.2 $SiO_2$). The product had an oil-absorbing capacity of 200 ml/100 g, a relative amount of the pores having a diameter of smaller than 0.1 μm of 8.2% by volume, a relative amount of the pores having a diameter in the range of 0.1 to 2.0 μm of 78.8% by volume and a water content of 9% by weight.

COMPARATIVE SYNTHESIS EXAMPLE A-1

51.05 g of an aqueous sodium aluminate solution (concentration: about 50% by weight) having the same molar $Na_2O/Al_2O_3$ ratio as that in the aqueous sodium aluminate solution used in Synthesis Example A-1 was added to 55 g of deionized water. 268.3 g of an aqueous No. 3 water glass solution as that of Synthesis Example A-2 was added dropwise into the resultant solution under stirring at 40° C. for 20 min to effect a reaction. After the completion of the dropwise addition, the resultant solution was heated to 50° C., and then the reaction was further conducted at that temperature for additional 30 min. The wet cake thus obtained was dried at 200° C. for 6 hr and then finely pulverized on a crusher to obtain an aluminosilicate powder.

According to atomic absorption spectrometry and plasma atomic emission spectrometry, the resultant powder comprised 29.7% by weight of $Al_2O_3$, 52.5% by weight of $SiO_2$ and 17.8% by weight of $Na_2O$ (0.99 $Na_2O.Al_2O_3$.3.0 $SiO_2$). The product had an oil-absorbing capacity of 210 ml/100 g, a relative amount of the pores having a diameter of smaller than 0.1 μm of 43% by volume, a relative amount of the pores having a diameter in the range of 0.1 to 2.0 μm of 45% by volume, and a water content of 12% by weight.

COMPARATIVE SYNTHESIS EXAMPLE A-2

A wet cake was produced in the same manner as that of Synthesis Example A-2, The wet cake was dried at 100° C. for 6 hr and then finely pulverized on a crusher to obtain amorphous aluminosilicate powder, According to atomic absorption spectrometry and plasma atomic emission spectrometry, the resultant amorphous aluminosilicate powder comprised 27.2% by weight of $Al_2O_3$, 51.2% by weight of $SiO_2$ and 21.6% by weight of $Na_2O$ (1.31 $Na_2O.Al_2O_3$.3.2 $SiO_2$). The product had an oil-absorbing capacity of 200 ml/100 g, a relative amount of the pores having a diameter of smaller than 0.1 μm of 8.2% by volume, a relative amount of the pores having a diameter in the range of 0.1 to 2.0 μm of 78.8% by volume, and a water content of 28.5% by weight.

COMPARATIVE SYNTHESIS EXAMPLE A-3

A wet cake was produced in the same manner as that of Comparative Synthesis Example A-1. The wet cake was dried at 200° C. for 15 hr and then finely pulverized on a crusher to obtain amorphous aluminosilicate powder.

According to atomic absorption spectrometry and plasma atomic emission spectrometry, the resultant amorphous aluminosilicate powder comprised 29.7% by weight of $Al_2O_3$, 52.5% by weight of $SiO_2$ and 17.8% by weight of $Na_2O$ (0.99 $Na_2O.Al_2O_3$.3.0 $SiO_2$). The product had an oil-absorbing capacity of 210 ml/100 g, a relative amount of the pores having a diameter of smaller than 0.1 μm of 43% by volume, a relative amount of the pores having a diameter in the range of 0.1 to 2.0 μm of 45% by volume, and a water content of 3.5% by weight.

EXAMPLE 1

3% by weight of sodium salts of beef tallow fatty acids, each of amorphous aluminosilicates, zeolite and each of salts listed in Tables 1 and 2 in amounts given also in the Tables, and 0.5% by weight of a fluolescent dye were fed into a stirred tumbling granulator (Lödige mixer). A liquid nonionic surfactant (polyoxyethylene synthetic alcohol ether having a melting point of 15° C., an average molar number of added ethylene oxide of 7 and an average number of carbon atoms in the alcohol of 12 to 14) was slowly introduced thereinto under stirring. Then 2% by weight of molten polyoxyethylene glycol was added to the resultant mixture, followed by the addition of 0.5% by weight of an enzyme, 0.5% by weight of a fragrance and 2% by weight of water thereto under stirring to obtain each of powdery detergent compositions listed in Tables 1 and 2.

The solubilities and caking resistances of these powdery detergent compositions were determined by the following methods. Results are given in Tables 1 and 2.

Evaluation method

1. Solubility test:

The powdery detergent composition was fed into a sample bottle and the bottle was tightly sealed and left to stand at 30° C. and 70% RH for 3 days. Then 1.0 g of the powdery detergent composition was sampled and added to 1 l of city water maintained at 10° C., 30° C. or 40° C., and the resultant mixture was stirred with a magnetic stirrer for 10 min. The mixture thus obtained was filtered through a 200-mesh metal gauze and the filter cake on the mesh was dried to determine the filter cake percentage (%) after drying.

2. Caking resistance test:

(1) An open box having a size of 10.2 cm×6.2 cm×4 cm (height) was prepared from a filter paper (Toyo Filter paper No. 2). The four corners were fastened with a stapler.

(2) 50 g of a sample (powdery detergent composition) was put in the box, and then an acrylic resin plate and a lead plate (or iron plate) [total weight: 265 g (250 g+15 g)] were placed on the sample.

(3) The box containing the sample was left to stand in a thermohygrostatic vessel at a temperature of 30° C. and a humidity of 80% for 7 days, and then the state of caking of the sample was evaluated.

The caking resistance was evaluated from the passing rate of the sample determined as follows.

Passing rate

After the test, the sample was softly placed on a metal gauze (or a sieve having a mesh of 5 mm×5 mm) and the powder passing through the metal gauze was weighed. The passing rate of the sample after the test was determined according to the following formula:

$$\text{Passing rate (\%)} = \frac{\text{weight (g) of passing powder}}{\text{total weight (g) of sample}} \times 100$$

TABLE 1

| | | | Exp. No. | | | | | |
|---|---|---|---|---|---|---|---|---|
| | | | 1-1 | 1-2 | 1-3 | 1-4 | 1-5 | 1-6 |
| Compn. (wt. %) | polyoxyethylene synthetic alcohol ($C_{12}$ to $C_{14}$) ether (m.p.: 15° C., $EO\bar{p}$ = 7) | | 25 | 20 | 15 | 20 | 30 | 25 |
| | salt | sodium carbonate | 15 | 15 | 15 | 20 | 10 | |
| | | sodium citrate | 6.5 | | 10 | | 9 | 10 |
| | | sodium sulfate | | 6.5 | 11.5 | 31.5 | | 16.5 |
| | | sodium polyacrylate | | 5 | | 5 | | 5 |
| | | sodium tripoly-phosphate | | | | | | 15 |
| | amorphous alumino-silicate | Synth. Ex. A-1 | 20 | 15 | | | 10 | |
| | | Synth. Ex. A-2 | | | 10 | 15 | 12.5 | 20 |
| | | Comp. Synth. Ex. A-1 | | | | | | |
| | | Comp. Synth. Ex. A-2 | | | | | | |
| | | Comp. Synth. Ex. A-3 | | | | | | |
| | type-4A zeolite | | 25 | 30 | 30 | | 20 | |
| Evaluation result | soly. test | 10° C. filter cake percentage (%) | 0.0 | 0.0 | 0.0 | 0.0 | 0.0 | 0.0 |
| | | 30° C. filter cake percentage (%) | 0.0 | 0.0 | 0.1 | 0.0 | 0.1 | 0.0 |
| | | 40° C. filter cake percentage (%) | 0.1 | 0.0 | 0.1 | 0-0 | 0.1 | 0.0 |

TABLE 1-continued

| | | Exp. No. | | | | | |
|---|---|---|---|---|---|---|---|
| | | 1-1 | 1-2 | 1-3 | 1-4 | 1-5 | 1-6 |
| | caking resistance [passing rate (%)] | 100 | 100 | 100 | 98 | 100 | 98 |

TABLE 2

| | | | Exp. No. | | | | | |
|---|---|---|---|---|---|---|---|---|
| | | | 1-7 | 1-8 | 1-9 | 1-10 | 1-11 | 1-12 |
| Compn. (wt. %) | polyoxyethylene synthetic alcohol ($C_{12}$ to $C_{14}$) ether (m.p.: 15° C., $E\bar{O}p = 7$) | | 25 | 20 | 15 | 30 | 30 | 25 |
| | salt | sodium carbonate | 15 | 15 | 15 | | | |
| | | sodium citrate | 6.5 | | 10 | | 10 | |
| | | sodium sulfate | | 6.5 | 11.5 | | 14 | |
| | | sodium polyacrylate | | 5 | | | | |
| | | sodium tripoly-phosphate | | | | | 15 | |
| | amorphous alumino-silicate | Synth. Ex. A-1 | | | | 22.5 | | |
| | | Synth. Ex. A-2 | | | | | | |
| | | Comp. Synth. Ex. A-1 | 20 | | | | 22.5 | |
| | | Comp. Synth. Ex. A-2 | | 15 | | | | |
| | | Comp. Synth. Ex. A-3 | | | 10 | | | 20 |
| | type-4A zeolite | | 25 | 30 | 30 | 39 | | 46.5 |
| Evaluation result | soly. test | 10° C. filter cake percentage (%) | 0.0 | 0.0 | 0.1 | 0.0 | 0.1 | 0.0 |
| | | 30° C. filter cake percentage (%) | 4.8 | 5.5 | 4.4 | 3.2 | 6.2 | 6.2 |
| | | 40° C. filter cake percentage (%) | 7.6 | 8.1 | 7.0 | 5.8 | 8.5 | 9.8 |
| | caking resistance [passing rate (%)] | | 100 | 100 | 67 | 100 | 97 | 64 |

Note) $E\bar{O}p$ in Tables 1 and 2 incidates the average molar number of added ethylene oxide.

SYNTHESIS EXAMPLE B-1

Sodium carbonate was dissolved in deionized water to prepare a 6 wt. % aqueous solution thereof. Separately, 243 g of $Al(OH)_3$ and 298.7 g of a 48 wt. % aqueous NaOH solution were fed into a four-necked flask having a capacity of 1000 ml. The content of the flask was heated to 110° C. under stirring and then maintained at that temperature for 30 min under stirring to prepare an aqueous sodium aluminate solution.

132 g of the aqueous sodium carbonate solution and 38.28 g of the aqueous sodium aluminate solution (concentration: about 50% by weight) were fed into a 1000-ml reaction tank provided with a baffle plate. 201.4 g of an aqueous No. 3 water glass solution prepared by diluting the water glass with twice as much water was added dropwise into the obtained solution mixture under vigorous stirring at 40° C. to effect a reaction for 20 min. In this step, the pH of the reaction system was adjusted to 10.5 by blowing carbon dioxide gas to realize the optimum reaction rate. After the completion of the reaction step, the reaction system was heated to 50° C. and then aging was conducted, i.e., the reaction system was left to stand, at that temperature for 30 min. After the completion of the aging step, carbon dioxide gas was blown into the reaction system to neutralize the excess alkali (pH of the system: 9). The neutralized slurry thus obtained was filtered through a filter paper (No. 5C; a product of Toyo Roshi Kabushiki Kaisha) under reduced pressure. The filter cake was washed with 1000 times as much water, filtered and dried (105° C., 300 Torr, 10 hr). The product thus obtained was crushed to obtain the amorphous aluminosilicate powder according to the present invention.

According to atomic absorption spectrometry and plasma atomic emission spectrometry, the resultant amorphous aluminosilicate powder comprised 29.6% by weight of $Al_2O_3$, 52.4% by weight of $SiO_2$ and 18.0% by weight of $Na_2O$ (1.0 $Na_2O.Al_2O_3.3.01\ SiO_2$). The product had a calcium ion exchange capacity of 165 $CaCO_3$ mg/g, an oil-absorbing capacity of 265 ml/100 g, a relative amount of the pores having a diameter of smaller than 0.1 μm of 9.4% by volume, a relative amount of the pores having a diameter in the range of 0.1 to 2.0 μm of 76.3% by volume and a water content of 11.2% by weight.

SYNTHESIS EXAMPLE B-2

55 g of the 6 wt. % aqueous sodium carbonate solution as that of Synthesis Example B-1, 51.04 g of an aqueous sodium aluminate solution as that of Synthesis Example B-1 and 25 g of ethanol were fed into a 1000-ml reaction tank provided with a baffle plate. 268.5 g of an aqueous No. 3 water glass solution as that of Synthesis Example B-1 and 0.5 g of calcium chloride dihydrate were added dropwise into the obtained solution mixture under vigorous stirring at 40° C. to effect a reaction for 20 min. In this step, the pH of the reaction system was adjusted to 11 by adding citric acid to the reaction system. After the completion of the reaction step, the reaction system was heated to 40° C. and then aging was conducted, i.e., the reaction system was left to stand, at that temperature for 30 min. After the completion of the aging step, carbon dioxide gas was blown into the reaction system to neutralize the excess alkali (pH of the system: 9.8). The neutralized slurry thus obtained was filtered, washed, filtered, dried and crushed in the same manner as those of Synthesis Example B-1 to obtain the amorphous aluminosilicate powder according to the present invention.

According to atomic absorption spectrometry and plasma atomic emission spectrometry, the resultant amorphous aluminosilicate powder comprised 29.3% by weight of $Al_2O_3$, 52.2% by weight of $SiO_2$, 17.7% by weight of $Na_2O$ and 0.8% by weight of CaO (0.99 $Na_2O$.0.05 $CaO.Al_2O_3$.3.03 $SiO_2$). The product had a calcium ion exchange capacity of 164 $CaCO_3$ mg/g, an oil-absorbing capacity of 310 ml/100 g, a relative amount of the pores having a diameter of smaller than 0.1 μm of 10.3% by volume, a relative amount of the pores having a diameter in the range of 0.1 to 2.0 μm of 74.2% by volume and a water content of 10.9% by weight.

COMPARATIVE SYNTHESIS EXAMPLE B-1

55 g of deionized water and 51.04 g of an aqueous sodium aluminate solution as that of Synthesis Example B-1 were fed into a 1000-ml reaction tank provided with a baffle plate. 268.5 g of an aqueous No. 3 water glass solution as that of Synthesis Example B-1 was added dropwise into the obtained solution mixture under vigorous stirring at 40° C. to effect a reaction for 20 min. After the completion of the reaction step, the reaction system was heated to 50° C. and then aging was conducted, i.e., the reaction system was left to stand, at that temperature for 30 min. The obtained reaction slurry was filtered, washed, filtered, dried and crushed in the same manner as that of Synthesis Example B-1.

According to atomic absorption spectrometry and plasma atomic emission spectrometry, the resultant amorphous aluminosilicate powder comprised 29.8% by weight of $Al_2O_3$, 52.5% by weight of $SiO_2$ and 17.7% by weight of $Na_2O$ (0.98 $Na_2O.Al_2O_3$.3.00 $SiO_2$). The product had a calcium ion exchange capacity of 1:33 $CaCO_3$ mg/g, an oil-absorbing capacity of 150 ml/100 g, a relative amount of the pores having a diameter of smaller than 0.1 μm of 40% by volume, a relative amount of the pores having a diameter in the range of 0.1 to 2.0 μm of 44% by volume, and a water content of 11.3% by weight.

EXAMPLE 2

3% by weight of sodium salts of beef tallow fatty acids, each of amorphous aluminosilicates, zeolite and each of salts listed in Table 3 in amounts given also in the Table, and 0.5% by weight of a fluorescent dye were fed into a stirred tumbling granulator (Lödige mixer). A liquid nonionic surfactant (polyoxyethylene synthetic alcohol ether having a melting point of 15° C., an average molar number of added ethylene oxide of 7 and an average number of the carbon atoms in the alcohol of 12 to 14) was slowly introduced thereinto under stirring. Then, 2% by weight of molten polyoxyethylene glycol was added to the resultant mixture, followed by the addition of 0.5% by weight of an enzyme, 0.5% by weight of a fragrance and 2% by weight of water under stirring to obtain each of powdery detergent compositions listed in Table 3.

The solubility test of these powdery detergent compositions was conducted in the same manner as that described in Example 1. The results are given in Table 3.

TABLE 3

| | | | Exp. No | | | | | | |
|---|---|---|---|---|---|---|---|---|---|
| | | | 2-1 | 2-2 | 2-3 | 2-4 | 2-5 | 2-6 | 2-7 |
| Compn. (wt. %) | polyoxyethylene synthetic alcohol ($C_{12}$ to $C_{14}$) ether (m.p.: 15° C., EO$\bar{p}$ = 7) | | 25 | 20 | 15 | 30 | 25 | 15 | 20 |
| | type-4A zeolite | | 30 | 30 | | 30 | 30 | 40 | |
| | salt | sodium carbonate | 16.5 | 15 | 10 | 8.5 | 14.5 | 15 | 20 |
| | | sodium citrate | | | 35 | | | | 30 |
| | | sodium sulfate | | 11.5 | 21.5 | | | 9.5 | 5.5 |
| | amorphous alumino-silicate | Synth. Ex. B-1 | 20 | | | 10 | | | |
| | | Synth. Ex. B-2 | | 15 | 10 | 13 | | | |
| | | Comp. Synth. Ex. B-1 | | | | | 22 | 12 | 16 |
| Evaluation result | soly. test | 10° C. filter cake percentage (%) | 0.0 | 0.0 | 0.0 | 0.0 | 0.1 | 0.0 | 0.1 |
| | | 30° C. | 0.0 | 0.0 | 0.1 | 0.0 | 5.2 | 4.8 | 7.0 |

TABLE 3-continued

| | Exp. No | | | | | | |
|---|---|---|---|---|---|---|---|
| | 2-1 | 2-2 | 2-3 | 2-4 | 2-5 | 2-6 | 2-7 |
| filter cake percentage (%) 40° C. filter cake percentage (%) | 0.1 | 0.0 | 0.1 | 0.0 | 8.3 | 7.7 | 9.4 |

Note) EOp̄ in Table 3 incidates the average molar number of added ethylene oxide.

EXAMPLE 3

Powdery detergent composition 1–3' was prepared in the same manner as that of powdery detergent composition 1–3, except that the amorphous aluminosilicate powder prepared in Synthsis Example B-1 was substituted for the amorphous aluminosilicate powder prepared in Synthsis Example A-2. The powdery detergent compositions 1–3 and 1–3' were stored at 30° C., 80%RH for 30 days. Then, the solubility tests of the powdery detergent compositions 1–3 and 1–3' were conducted in the same manner as that described in Example 1. The results are given in Table 4.

TABLE 4

| | | Exp. No. | |
|---|---|---|---|
| | | 1-3 | 1-3' |
| kind of amorphous aluminosilicate | | Synth. Ex. A-2 | Synth. Ex. B-1 |
| result of sol. test | 10° C. filter cake percentage (%) | 0.3 | 0.0 |
| | 30° C. filter cake percentage (%) | 0.4 | 0.1 |
| | 40° C. filter cake percentage (%) | 1.0 | 0.2 |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim is:

1. A nonionic powdery detergent composition comprising 12 to 40% by weight of the following component (a) and 5 to 60% by weight of the following component (b), said component (a) being absorbed in a powdery or granular starting material(s), including said component (b), of the detergent composition:

(a) a nonionic surfactant having a melting point of 40° C. or below, and (b) an amorphous aluminosilicate having a composition represented by the following formula (I):

$$x(M_2O).y(MeO).Al_2O_3.z(SiO_2) \quad (I)$$

wherein M represents an alkali metal atom, Me represents an alkaline earth metal atom, and x, y and z represent the molar numbers of the respective components, with the proviso that they satisfy the following relationship:

$$0.2 \leqq x \leqq 2.0,\ 0 \leqq y \leqq 0.1 \text{ and } 1.5 \leqq z \leqq 6.0,$$

and having an oil-absorbing capacity of at least 100 ml/100 g and a water content of 5 to 20% by weight, and wherein the volume of pores having diameters of smaller than 0.1 μm is at most 20% based on the total pore volume, and the volume of pores having diameters of 0.1 to 2.0 μm is at least 50% based on the total pore volume wherein the amorphous aluminosilicate (b) is produced by reacting an alkali metal aluminate with an alkali metal silicate while maintaining the pH of the reaction system in the range of 8 to 14 by the addition of at least one acidic agent selected from the group consisting of an inorganic acid, an organic acid and an acidic salt.

2. The nonionic powdery detergent composition according to claim 1, which contains 12 to 35% by weight of the component (a) and 5 to 40% by weight of the component (b).

3. The nonionic powdery detergent composition according to claim 1, wherein the nonionic surfactant (a) is a polyoxyethylene alkyl ether which has an average carbon atom number of 10 to 20 in its alkyl group and an average molar number of added ethylene oxide of 5 to 15.

4. The nonionic powdery detergent composition according to claim 1, wherein the reaction of an alkali metal aluminate with an alkali metal silicate comprises two steps: a reaction step and an aging step; the temperature of the reaction step being 15° to 60° C. and the temperature of the aging step being 15° to 100° C.

5. The nonionic powdery detergent composition according to claim 1, wherein after the reaction of an alkali metal aluminate with an alkali metal silicate, at least one acidic agent selected from the group consisting of an inorganic acid, an organic acid and an acidic salt is added to a slurry obtained by the above-described reaction to adjust the pH of the slurry within the range of 5 to 13 and at least 1 lower than that of the reaction system during the above-described reaction.

6. The nonionic powdery detergent composition according to claim 1, wherein the reaction system contains 0.5 to 50% by weight, of the entire amount of the reaction system, of a water-soluble solvent having a solubility parameter of 7.5 to 20, which is added to the raw material mixture prior to the reaction of an alkali metal aluminate with an alkali metal silicate or added to the reaction mixture in the course of the reaction.

7. The nonionic powdery detergent composition according to claim 1, wherein the amorphous aluminosilicate (b) has an oil-absorbing capacity of at least 150 ml/100 g and a calcium ion exchange capacity of at least 120 $CaCO_3$ mg/g.

8. The nonionic powdery detergent composition according to claim 1, wherein starting materials for the amorphous aluminosilicate (b) are an alkali metal aluminate having a molar ratio of $M_2O$ (M being an alkali metal atom) to $Al_2O_3$ in the range of 1.0 to 6.0 and an alkali metal silicate having a molar ratio of $SiO_2$ to $M_2O$ in the range of 1.0 to 4.0.

9. A nonionic powdery detergent composition comprising 12 to 35% by weight of the following component (a), 5 to 40% by weight of the following component (b) and 5 to 70% by weight of the following component (c), said component (a) being absorbed in a powdery or granular starting material(s), including said component (b), of the detergent composition:

(a) a nonionic surfactant having a melting point of 40° C. or below, (b) an amorphous aluminosilicate having a composition represented by the following formula (I):

$$x(M_2O).y(MeO).Al_2O_3.z(SiO_2) \quad (I)$$

wherein M represents an alkali metal atom, Me represents an alkaline earth metal atom, and x, y and z represent the molar numbers of the respective components, with the proviso that they satisfy the following relationship:

$$0.2 \leqq x \leqq 2.0,\ 0 \leqq y \leqq 0.1 \text{ and } 1.5 \leqq z \leqq 6.0,$$

and having an oil-absorbing capacity of at least 100 ml/100 g and a water content of 5 to 20% by weight, and wherein the volume of pores having diameters of smaller than 0.1 μm is at most 20% based on the total pore volume and the volume of pores having diameters of 0.1 to 2.0 μm is at least 50% based on the total pore volume, and (c) an alkaline salt and/or a neutral salt.

10. A nonionic powdery detergent composition comprising 12 to 35% by weight of the following component (a), 5 to 40% by weight of the following component (b), 5 to 70% by weight of the following component (c) and 10 to 60% by weight of the following component (d), said component (a) being absorbed in a powdery or granular starting material(s), including said component (b), of the detergent composition:

(a) a nonionic surfactant having a melting point of 40° C. or below, (b) an amorphous aluminosilicate having a composition represented by the following formula (I):

$$x(M_2O).y(MeO).Al_2O_3.z(SiO_2) \quad (I)$$

wherein M represents an alkali metal atom, Me represents an alkaline earth metal atom, and x, y and z represent the molar numbers of the respective components, with the proviso that they satisfy the following relationship:

$$0.2 \leqq x \leqq 2.0,\ 0 \leqq y \leqq 0.1 \text{ and } 1.5 \leqq z \leqq 6.0,$$

and having an oil-absorbing capacity of at least 100 ml/100 g and a water content of 5 to 20% by weight, and wherein the volume of pores having diameters of smaller than 0.1 μm is at most 20% based on the total pore volume and the volume of the pores having a diameter of 0.1 to 2.0 μm is at least 50% based on the total pore volume, (c) an alkaline salt and/or a neutral salt, and (d) a crystalline aluminosilicate.

* * * * *